US007292983B2

(12) United States Patent
Yazu

(10) Patent No.: US 7,292,983 B2
(45) Date of Patent: Nov. 6, 2007

(54) VOICE SYNTHESIS APPARATUS

(75) Inventor: Takashi Yazu, Kanagawa (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 711 days.

(21) Appl. No.: 10/017,927

(22) Filed: Dec. 18, 2001

(65) Prior Publication Data

US 2003/0171923 A1 Sep. 11, 2003

(30) Foreign Application Priority Data

Aug. 14, 2001 (JP) ..... 2001-246064

(51) Int. Cl.
*G10L 13/08* (2006.01)
*G10L 13/00* (2006.01)

(52) U.S. Cl. ..... 704/260

(58) Field of Classification Search ..... 704/258, 704/260

See application file for complete search history.

(56) References Cited

U.S. PATENT DOCUMENTS 5,555,343 A * 9/1996 Luther ..... 704/260
6,256,610 B1 * 7/2001 Baum ..... 704/260
6,411,931 B1 * 6/2002 Yamada ..... 704/260

FOREIGN PATENT DOCUMENTS

JP 9-16196 1/1997

* cited by examiner

*Primary Examiner*—Angela Armstrong
(74) *Attorney, Agent, or Firm*—Volentine & Whitt, P.L.L.C.

(57) ABSTRACT

A voice synthesis apparatus for analyzing characters including a symbol character and for outputting the characters by voice synthesis, includes a first detection module that detects a paragraph section having a repetition of a plurality of kinds of a symbol based on a character column in one line; and a voice synthesis module for performing voice synthesis for a rest of character column and deleting the symbol character column interval from the character line.

8 Claims, 8 Drawing Sheets

BLOCK DIAGRAM OF VOICE SYNTHESIS APPARATUS EMBODIMENT OF THE PRESENT EMBODIMENT

BLOCK DIAGRAM OF VOICE SYNTHESIS APPARATUS EMBODIMENT OF THE PRESENT EMBODIMENT

PROCESSING FLOW IN FIRST EMBODIMENT OF ADVANCED PROCESSOR 102

PROCESSING FLOW IN SECOND EMBODIMENT OF ADVANCED PROCESSOR 102

SYNMETRY PATTERN JUDGMENT PROCESSING FROW OF S46 IN FIG. 4

MODEL DIAGRAM SHOWING PROCESSING CONTENT IN FIG. 5

CONSTITUTION DIAGRAM OF CONVENTIONAL TEXT VOICE SYNTHESIS APPARATUS

VOICE SYNTHESIS APPARATUS

BACKGROUND OF THE INVENTION

1. Field of the Invention

The present invention relates to a text-to-speech synthesis apparatus, which inputs a text composed of a mixture of "HIRAGANA" and "KATAKANA" Chinese characters including a symbol such as a word, and composition, which then converts the input text into voice. More particularly, the present invention relates to processing symbols incorporated in a text.

2. Description of the Related Art

FIG. 8 is a constitution diagram of a conventional text-to-speech synthesis apparatus. Conventionally, the text-to-speech synthesis includes a text analysis unit 803 and a speech-synthesis-by-rule unit (parameter generator 805 and voice synthesis unit 806).

When a character column is input into a preprocessor 802, a character not to be read is deleted and an analysis unit (one sentence) is cut, and the sentence is output to a text analysis unit 803. In the text analysis unit 803, the sentence is decomposed into words by referring to a word dictionary 804; pronunciation, accent type of each word, and intonation of phrase are determined, and a phonetic symbol with a prosodic symbol (Interlanguage) is output. The speech-synthesis-by-rule unit includes a parameter generator 805 and a voice synthesis unit 806, and speech synthesis is performed based on the Interlanguage.

In the parameter generator 805, voice segment addresses in a voice segment dictionary 807 are selected, and pitch patterns, phoneme duration, pause length, amplitude, and the like are set.

In the voice synthesis unit 806, voice segment data corresponding to phonetic symbols are selected from voice segment dictionary 807, and voice segments are combined/changed to allow voice synthesis processing in accordance with a parameter determined in the parameter generator 805.

A text includes not only a general symbol including the end of a section of a word, a postpositional word and a phrase, a punctuation mark showing an end of a section, and a colon/or semi colon showing apposition/exemplary but also various symbols such as an interval, a bracket, a scientific symbol, a unit symbol, a rule and a special symbol. When all kinds of symbols in input text are spoken, it is useful for the particular application such as collation check to be carried out. However, when these symbols are spoken, the sounds of the symbols irritate users in general use.

However, a conventional synthesis apparatus provides an operation mode to read a symbol, and also provides an operation mode not to read aloud the symbol, so that the user may be capable of selecting the mode. In a normal operation the mode is set not to read aloud a symbol character. In a preprocessor 802 of FIG. 8, a symbol character in a text is detected. The symbol is deleted and then the text is analyzed when the operation is set so as to not read the symbol.

On the other hand, there is a case where reading of the symbol is not limited and the symbol character should be spoken as the symbol. In that case, the continuous symbol is used as a paragraph section line as an expression often used in a general text such as "-----". If a symbol column in this case is output by voice such as ⌈hyphen, hyphen, hyphen, . . . ⌋per one character, this further irritates users.

A module to judge a plurality of successive symbols in a preprocessor and a countermeasure is taken as disclosed in, for example, Japanese Laid Open publication No. 9-016196. The countermeasure is that for N or more number of symbols, even if read, the symbol is set and is output as another reading, a sign tone, a voiceless part, a different speed, sound quality, and a synthesis tone of sound volume, which are listened to without any feeling.

In recent years, voice quality of a text-to-speech synthesis apparatus has rapidly improved, and voice guidance in car navigation and voice auto information guide systems have become more common. The ability to read aloud electric mail is one of the main applications. Electronic mail has expressions such as a visual variety of intensions or appearances arising from recent rapid use.

A simple description such as a line of asterisks (*) or hyphens (-) is not used for a paragraph section line but various descriptions are used as shown in a table 1. Descriptions shown in table 1 are just one example, however, in all examples, detection is not possible in a conventional manner to judge symbol repetition. There is a problem that the conventional systems read aloud all symbols in one line, or one part of a symbol in a line as the symbol is spoken.

TABLE 1

| No. | Expression's example of paragraph section line |
|---|---|
| 1 | . – . – . – . – . – . – . – . – . – . – . – . – . – . – . – . – . – . |
| 2 | ◆ ◆ ◆ ◆ ◆ ◆ ◆ ◆ ◆ ◆ ◆ ◆ ◆ ◆ ◆ ◆ |
| 3 | _/_/_/_

interval for the rest of the character columns in which symmetry of the row of symbol character columns is deleted from the line, is synthesized as voice.

According to the present invention, a voice synthesis apparatus in which the first detection module detects symmetry of a row of symbol character columns, in addition to this, a symbol character column interval composed of the symbol column to be deleted when a predetermined symmetry shaped symbol is identified and a pair of symbol shaped symbols is at a symmetrical position.

DETAILED DESCRIPTION OF THE INVENTION

The invention will now be described based on preferred embodiments, which do not intend to limit the scope of the present invention, but rather to exemplify the invention. All of the features and the combinations thereof described in the embodiments are not necessarily essential to the invention.

Figure 1:
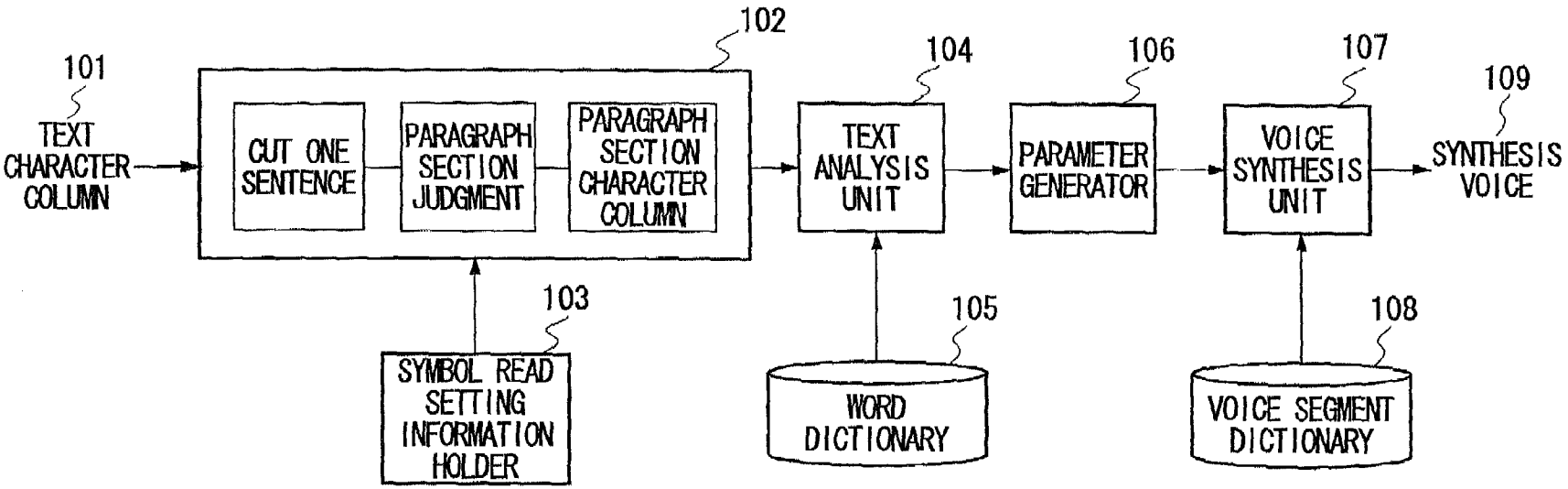
FIG. 1 is a block diagram showing a constitution of a voice synthesis apparatus in an embodiment of the present invention.

FIG. 1 shows a constitution diagram of a voice synthesis apparatus (Text-to-speech synthesis apparatus) in an embodiment of the present invention. The voice synthesis apparatus includes a preprocessor 102 in which text is input, a symbol read setting information holder 103, a text analysis unit 104, a word dictionary 105, a parameter generator 106, a voice synthesis unit 107, and a voice segment dictionary 108.

Figure 2:
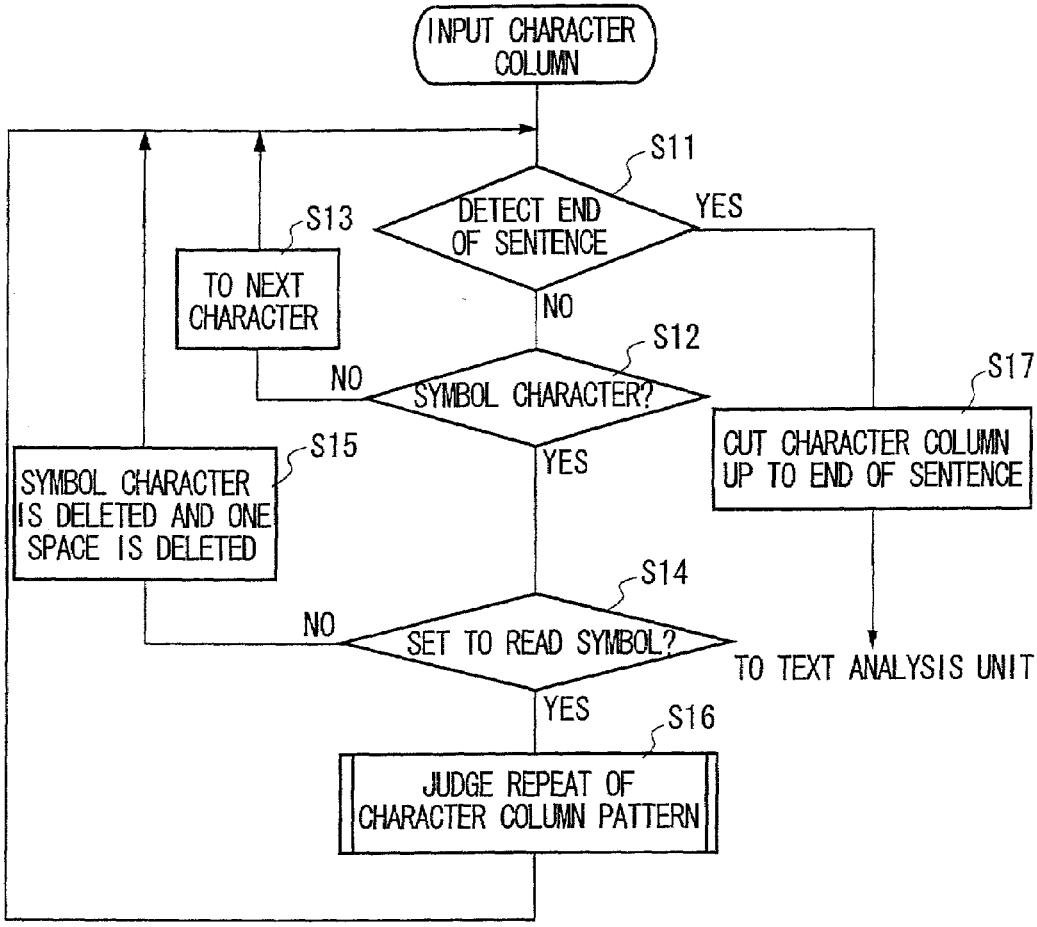
FIG. 2 is a flowchart showing a flow of a processing in a first embodiment of a preprocessor 102.
Figure 3:
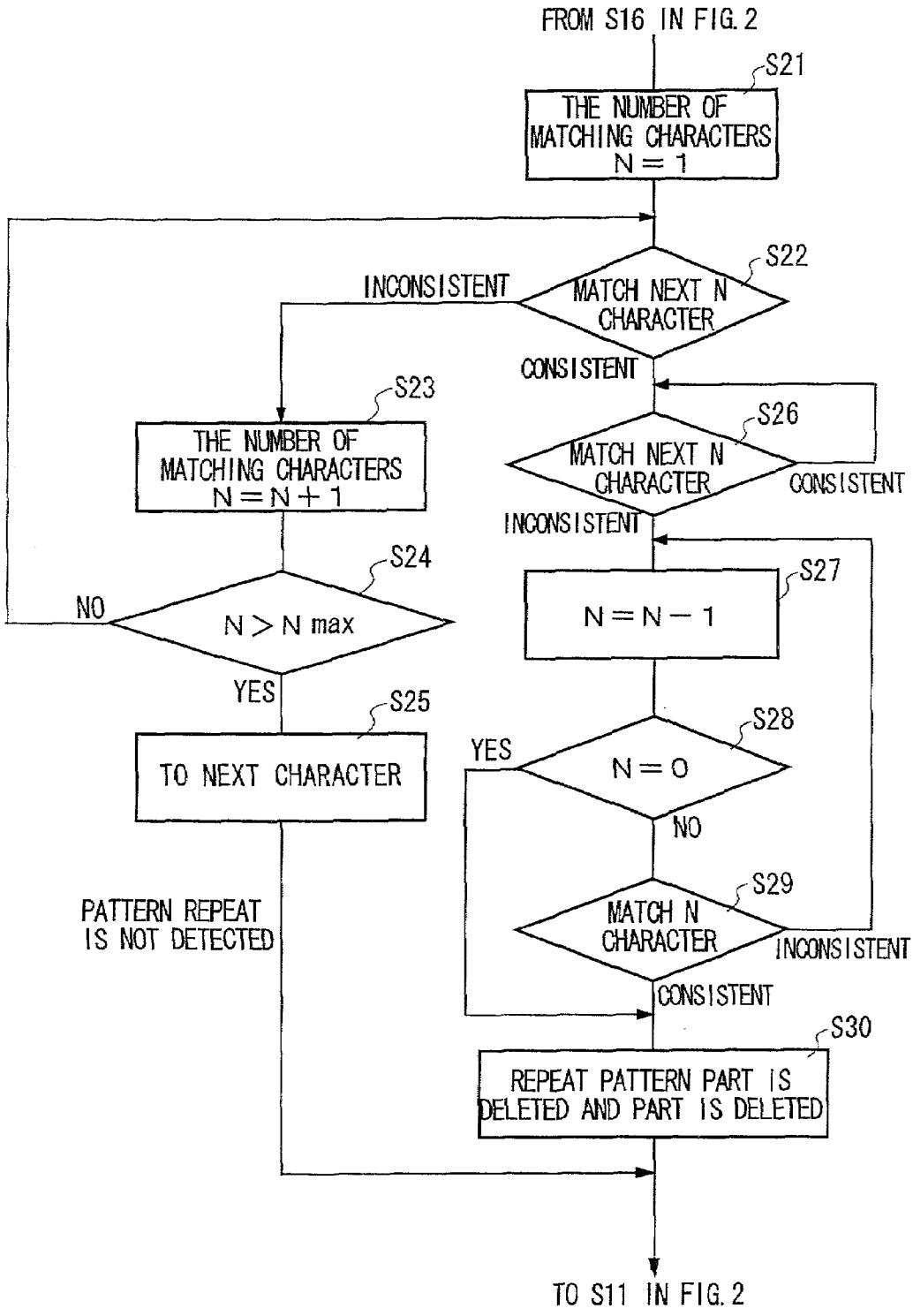
FIG. 3 is a flowchart showing a flow of a processing at S16 in FIG. 2.

FIGS. 2 and 3 are flowcharts explaining a flow of a processing in a first embodiment of the preprocessor 102. The symbol read setting information holder 103 holds set information on whether operation modes are to read a symbol or not to read it. A symbol not to be read is deleted, character column pattern repetition is detected and the detected pattern is deleted based on set information of the symbol read setting information holder 103 in the preprocessor 102.

Figure 8:
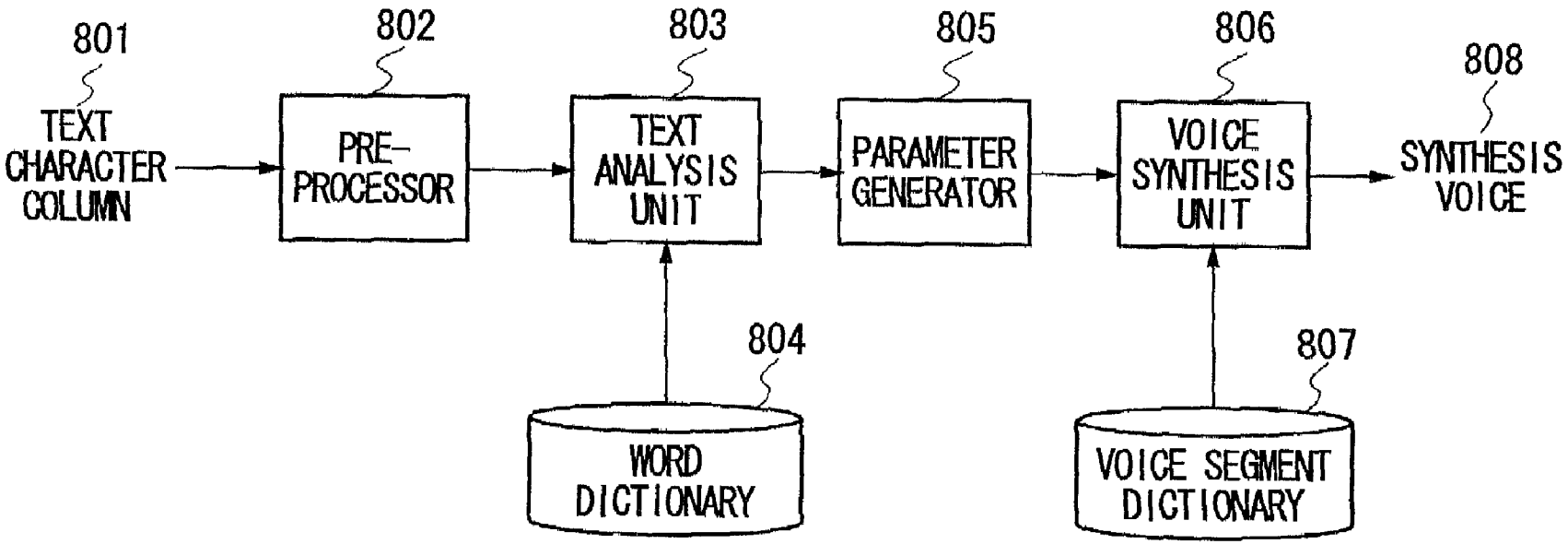
RELATED ART FIG. 8
FIG. 8 is a constitution diagram a conventional text-to-speech synthesis apparatus.

A constitution of a processing block right after the text analysis unit 104 may have a function and constitution similar to a conventional text-to-speech synthesis apparatus (See FIG. 8). The text analysis unit 104 receives a text from preprocessor 102 in which a processing for the symbol is finished, the word dictionary 105 is referred and a morphological analysis is performed and pronunciation and accent are assigned and intonation are determined and a phonetic symbol with a prosodic symbol (Interlanguage) is output. The parameter generator 106 determines an address in a voice segment dictionary 108 of a voice segment to be used for synthesis, based on Interlanguage and sets a pitch frequency pattern, a duration of each phoneme, or an amplitude. Various synthesis methods can be applied in a voice synthesis unit 107 and a pitch synchronous overlap add method (PSOLA) can be used.

A particular processing of the preprocessor 102 will be described referring to FIGS. 1 to 3. Each of the characters input into the preprocessor are checked from the start. Firstly, whether or not the character is a symbol marking an end of a sentence is judged at step 11 (S11). The end of a sentence is judged by ⌜○ (Stop)⌟ ⌜.(period)⌟ ⌜? (question mark)⌟, and the like. When the symbol marking an end of sentence is detected, a character column thereto is sent to the text analysis unit 104 as an analysis unit. Repeated processing of S12 in front is performed until the symbol marking the end of sentence is detected.

A kind of character is judged at S12. Judgment of character type is easily available in a range of a character code. There is an example in which not only a row of symbol characters but also a row of alphabets as a paragraph section line are used in a recent text. The alphabet may also be added as a kind of extra characters, however, whether or not the symbol character is judged in this embodiment. If the kind of character is not the symbol character, a pointer proceeds to a next character at S13 and returns to S11.

If the kind of character is the symbol character at S12, the pointer proceeds to S14, and whether an operation mode of a text-to-speech synthesis apparatus is the operation mode to read aloud the symbol, or the operation mode not to read aloud the symbol, is judged referring to the symbol read setting information holder 103. The operation mode not to read aloud the symbol and the operation mode to read aloud the symbol are included as an operation style of the voice synthesis apparatus. Preferably, consideration is given to not read all symbols in the mode where the symbol is not read. The constitution is considerable so as to read a special symbol, the symbol, which should read, for example, ⌜%⌟ ⌜+⌟ ⌜−⌟ ⌜=⌟ etc. However, the preprocessor 102 constituted as not to read the symbol in set not to read of the present embodiment.

If judgment S14 is set not to read the symbol, the symbol character is deleted at S15 and one space in all character columns in front of the deleted symbol character is deleted, and the processor returns to S11.

When the symbol character is detected and when it is judged the operation mode of the voice synthesis apparatus is set to read the symbol, it is judged how to process the symbol and the symbol character columns ahead at S16.

A plurality of continuous symbol character column patterns are detected at S16 and when the symbol character column patterns constitutes a paragraph section line by a row of symbols, the symbol column is deleted from input character column data so that the symbol column is not read even if an operation mode is the operation mode set to read the symbol.

A processing content at S16 is shown in detail in FIG. 3. The amount of characters that constitute a pattern varies in repeated pattern judgment. A pattern in which two characters are repeated is used as an example in Nos. 1 to 8 of a table 1. A pattern in which three characters are repeated is used in No. 11. A pattern is constituted by a unit of five characters in Nos. 9 and 10. A pattern constitution is checked while the number of characters that constitutes the pattern is sequentially incremented from a low number in a pattern repeated judgment.

At S21, an initial value N of the number of pattern characters is given. If N is 1, this is equal to continuously checking the same symbol. N=1 including the same symbol is given as an initial value.

At S22, a character column for an N-character from a character position in front of the N-character is matched with a character column for the N character from a first character position where the symbol is detected and whether or not the pattern is repeated is judged. When patterns are inconsistent; it is judged that N character is not repeated, processing goes to S23 and one character of the number of pattern characters is increased, the processing returns to S22 and matching is retried. Since an increase in the number of characters for matching without limitation does not make sense, $N_{max}$ of an upper limitation is provided for the number of pattern characters. In a general text, most of the repetition patterns can be detected if approximately five characters are provided for $N_{max}$ of an upper limitation. Therefore, whether or not the number of pattern characters to be checked exceeds $N_{max}$ of an upper limitation is judged at S24. When the number of pattern characters exceeds $N_{max}$ of an upper limitation, it is judged that there is no pattern repetition in a character column where it starts from the symbol character and a processing such as deletion of a character is not performed, a character position pointer proceeds to S25, and then the processing returns to S11 in FIG. 2.

The character column pattern matched at S22 is consistent and when it is judged that there is a repeat pattern, matching each N character is repeated at S26 and the whole of the interval that is repeated three times or more is extracted. Finally, if the character column pattern is not consistent, it will not always finish at a part where a paragraph section line is consistent. After a pattern of ⌈■ □ □ □ □⌋ is repeated five times as shown in the example of No. 9 in the table 1, one of ⌈■⌋ is ranged. The ⌈■⌋ obviously constitutes ⌈Part⌋a symbol column in front of ⌈■⌋ ahead and does not exist by itself. Since the length of a paragraph section line is adjusted at an end of the pattern, the part of repeated pattern is often used. In front of S27, the part of the character column pattern that has been detected prior is matched and thereby precision of detection of the paragraph section line interval is improved.

In particular, matching is repeated while the number of characters is decreased per one character until the number of pattern characters N becomes 0 at S27 to S29. During repetition, whether an interval exists where only the start end part of the pattern is consistent is checked, and an interval repeating the character column pattern including the number of ends of a pattern of an end of a symbol column is detected.

At S30, a character column pattern interval detected like this is considered as the paragraph section line and the interval is excluded from an object to be read, therefore, all of the character column is deleted, a character column right after the column that has been deleted is deleted and then the processing returns to S11 in FIG. 2.

In the present embodiment, the pattern is deleted unconditionally for simplification if the pattern is repeated at least once (repeat twice), however, it can also easily be realized to judge by providing a limiting rule such that the pattern is deleted if the pattern is repeated, for example, three times or more; if pattern length is long, the pattern is deleted even if the pattern is repeated twice; the pattern is not deleted twice if the pattern is short.

As described above, in the first embodiment, the voice synthesis apparatus analyzing the character column mixing the symbol character and reading the analyzed character column by synthesized voice includes a module removing a paragraph section character column for detecting a plurality of continuous symbol character column patterns that are detected from the character column, considering an interval repeating the symbol character column pattern as a paragraph section character column and removing a character column interval and then sending the text to the text analysis. Thereby, even if in an expression type repeating a pattern that is not continuous of the same symbol, a character is not read per a character and there is no confusion when listening to synthesis sound.

In a second embodiment of the preprocessor 102, a constitution is provided. The constitution can be suited for a description style of a symmetry row of the symbol characters such as in table 2 in which a pattern is not continuous of the same symbol and does not repeat the same character column pattern. Although the description style in Table 2 are examples, which are often described in the text, a symbol column described here is not consistent with repetition of the character column pattern in the first embodiment. In any of examples, the symmetry pattern of the symbol exists between general character columns, which is not the symbol.

TABLE 2

| No. | Expression's example of paragraph section line |
|---|---|
| 1 | ◆◇··· To user currently use ⌈ifstation⌋···◇◆ |
| 2 | ■□■ - Hot news -■□■ |
| 3 | →=≡●■■■!Big sale at end of year!■■■●≡=← |

Figure 4:
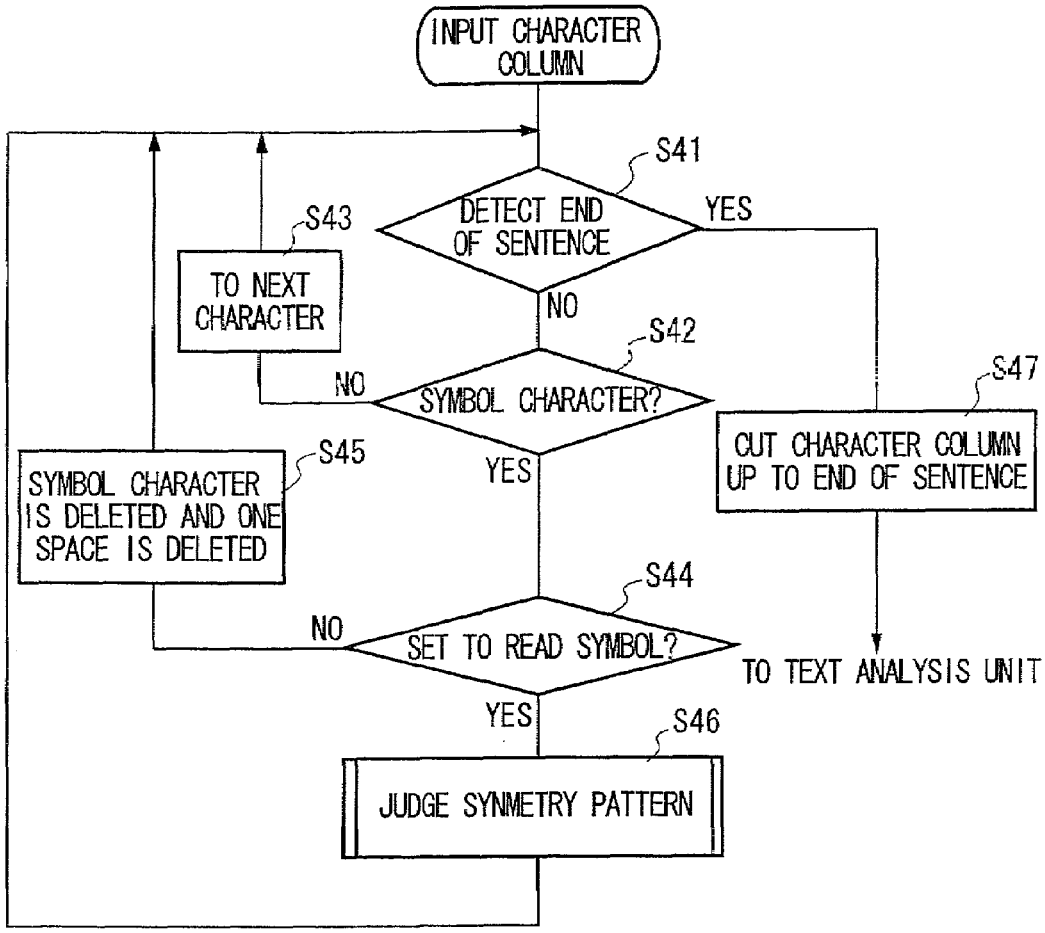
FIG. 4 is a flowchart showing a flow of a processing in a second embodiment of the preprocessor 102.

FIG. 4 is a flowchart that shows a processing flow in a second embodiment of the advanced processor 102. At S46, a symmetry pattern is judged rather than judgment of a repeat of a character column pattern at S16 in FIG. 2. A whole constitution is similar to a constitution in the first embodiment and at S41 to S45, and S47, the processings, which are the same as the processings S12 to S15, and S17 are respectively performed, therefore these descriptions are omitted.

Figure 5:
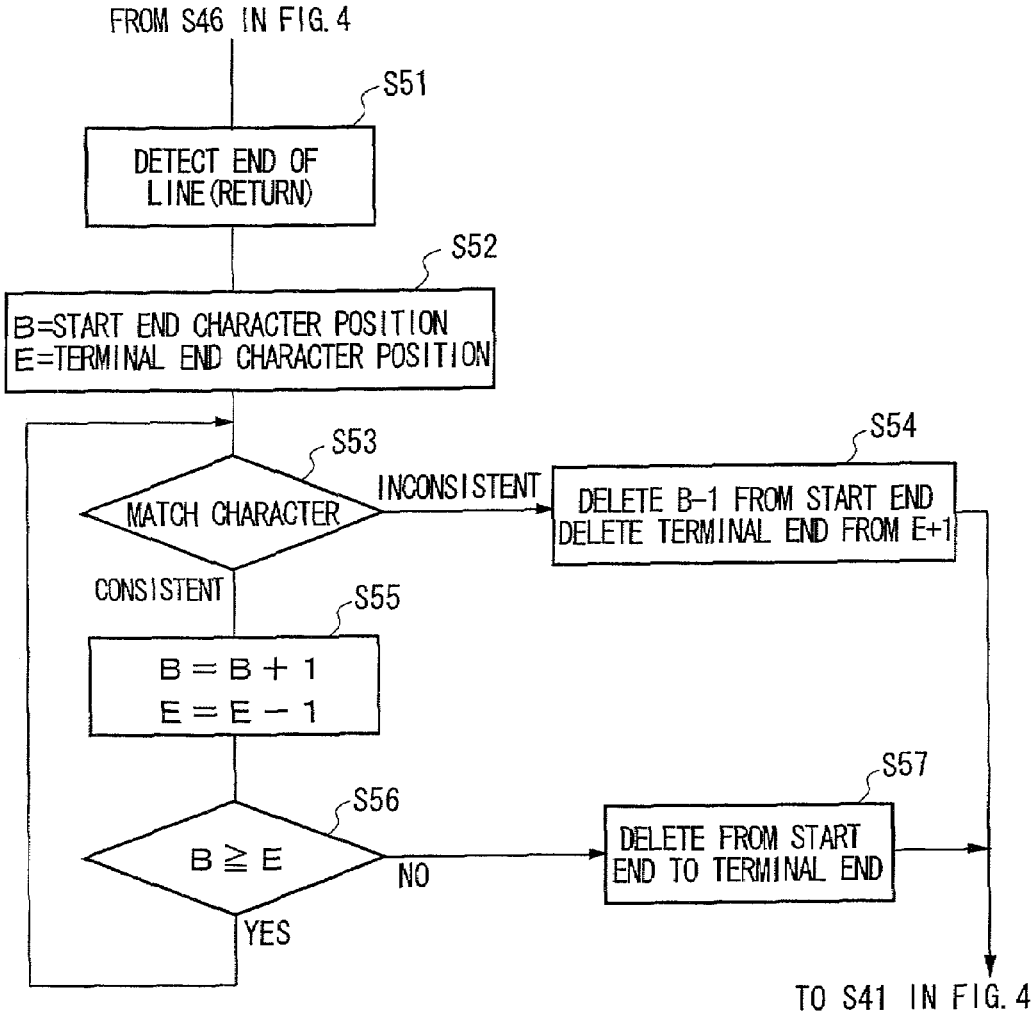
FIG. 5 is a flowchart showing a symmetry pattern judgment processing at S46 in FIG. 4.

FIG. 5 shows a judgment processing flow of a symmetry pattern at S46. To judge symmetry, at the end of the pattern prior to judgment, it is necessary to detect the end of the pattern. Firstly, an end of a line (return) is detected at S51 in FIG. 5. A reason for detecting a return is that in most of the cases a paragraph section line generally constitutes one line. The end of the pattern may, of course, be judged with high precision in consideration of a case where a character column exists in the same line after the symmetry pattern, however, this is very a rare case and only return judgment can achieve a sufficient function.

After the end of the pattern is detected at S51, character positions at both ends to be matched are set at S52. Initial values, needless to say, are a position (Start end) where the symbol character is first detected and a character (Terminal end) just before return is performed. A character at a character position B is matched with a character position E at S53 and whether or not the characters are consistent is checked. If the characters are consistent, pointers at the character positions of both ends are respectively moved towards inside one character at S55 and are coincided again. The characters of the start end and the terminal end are matched per one character until the character position pointers of the start end and the terminal end are consistent and crossed.

After the pointers are looped out at a point where matching is not consistent at S53 or at a point where the character position pointers of the start end and the terminal end are consistent and crossed at S56 and the consistent interval, that is, the symmetry interval is deleted, the processing returns to S41 in FIG. 4.

Processing of the character position pointers are different between at a point where matching is not consistent at S53 and at a point where the character position pointers of the start end and the terminal end are consistent and crossed at S56.

When character matching at S53 is inconsistent and looped out, the delete interval becomes an interval where characters are decreased per one character since the consistent character positions (symmetry is confirmed) are respectively positions where prior to one character of the terminal end and one character in front of the start end from the current character positions at S54.

Figure 6:
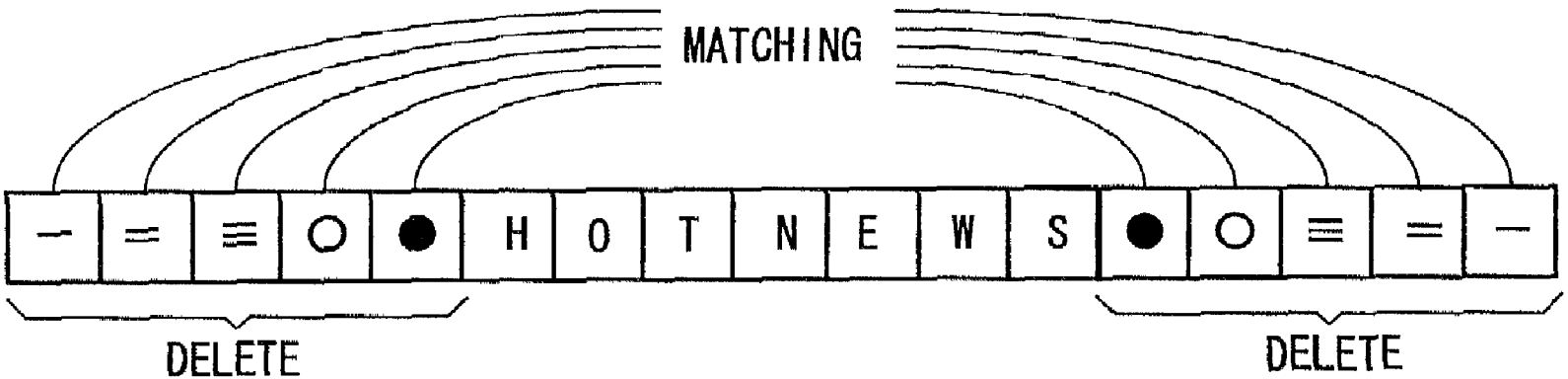
FIG. 6 is a model diagram showing a processing content of FIG. 5.

On the other hand, at S56 when characters are looped out, all characters are deleted from the start end to the terminal end since symmetry of the whole check interval is confirmed. FIG. 6 shows a processing content in FIG. 5.

In the second embodiment, it is constituted that a pattern is judged as the symmetry pattern if at least one character of the patterns of both ends have consistency in order to be simplified. However, there is a case where consistency of only one character accidentally exist in the text, therefore, preferably it is desirable that the pattern is judged as the symmetry pattern by counting the number of consistent characters and consistency of the preset number of characters or more (e.g., two characters or more).

Although only symmetry pattern judgment is performed at S46 in FIG. 4, symmetry pattern judgment and judgment repeating the character column pattern in the first embodiment is not an exclusive relation. It may, of course, be constituted so that judgment repeating the character column pattern is added and both the symmetry and repeat pattern are detected at the same time. In that case, there is a possibility that the natures of the patterns, which are originally symmetrical are lost prior to symmetry detection by detecting repeat pattern and deleting the character column. Therefore, the symmetry is judged in advance and sequentially repeat pattern is judged.

As described above, in the second embodiment, since a module is provided, the symbol is not read per one character in expression in an introduction line used in the text and thereby there is no confusion by listening to synthesis sound. The module deletes the character column for a symmetry interval when checking the symmetry of a symbol column before writing letters for the symbol.

Figure 7:
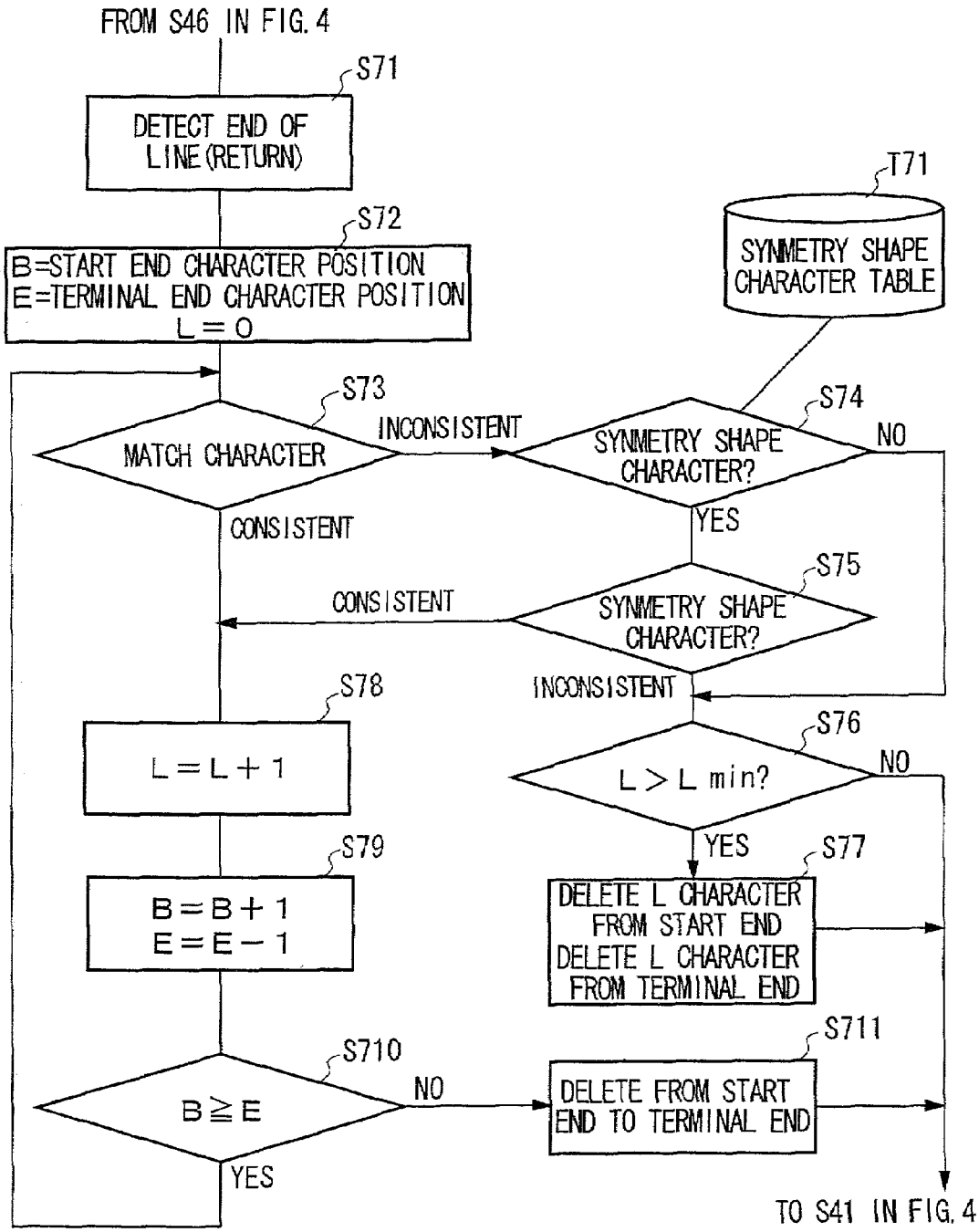
FIG. 7 is a flowchart showing a processing content at S46 in a third embodiment of the preprocessor 102.

In a third embodiment of the preprocessor 102, a symmetry shape character is discriminated and the character is processed the same as symmetry in judgment of a row of the symbol character symmetry. FIG. 7 is a flowchart showing a processing flow of a (see S46 in FIG. 4) of symbol pattern judgment in the present embodiment. It is constituted that a count processing of the number of consistent characters described as a preferable example in the embodiment of FIG. 2 is added. An example of Table 3 shows an example In which characters are added to the symmetry pattern and the characters are processed.

TABLE 3

| No. | Expression's example of paragraph section line |
|---|---|
| 1 | 〈 ❮ - Hot news - ❯ 〉 |

TABLE 3-continued

| No. | Expression's example of paragraph section line |
|---|---|
| 2 | 〈 【 !Big sale at end of year! 】 〉 |
| 3 | ▲▽Information△▼ |

Firstly, an end of a line (return) is detected and the end is detected at S71. Secondly, a character position B (start end) and a character position E (terminal end) of both ends to be matched and a counter of the consistent number of characters L are initially set at S72. Consistency or inconsistency for the characters of character position B and character position E is judged at S73. When the characters of the character position B and the character position E are consistent in judgment at S73, the processing goes to S79 to move the character position pointers inside, similar to the second embodiment after the number of consistent characters is totaled at S78. In contrast, even if a comparison is not consistent at S73, the possibility of a symmetry shape character is checked after S74.

Examples of symmetry shape characters are shown in Table 4. It is reasonable that when these characters are used in a row of symmetry, the characters are processed as the same characters in a case.

TABLE 4

| Example of symmetry shape symbol character column |
|---|
| 〈 〉 〈 〉 ⟨ ⟩ ⟨ ⟩ ⟨ ⟩

consistent. Therefore, the symbol is not read per one character in a description expression and there is no confusion by listening to synthesis sound.

Although the present invention has been described by way of exemplary embodiments, it should be understood that many changes and substitutions may be made by those skilled in the art without departing from the spirit and the scope of the present invention which is defined only by the appended claims. Although the symbol character is described as an object in the present embodiments 1 and 2, there is a case where an alphabet and another characters are aligned and are symbolically used. A kind of character to be objected is enlarged and can be matched.

What is claimed is:

1. A voice synthesis apparatus for analyzing characters including a symbol character and for outputting the characters by voice synthesis, comprising:

a first detection module that detects a paragraph section line having a recurrent string pattern and text characters in a series of characters of one line, wherein the recurrent string pattern comprises a plurality of strings each including a plurality of kinds of symbols, and wherein a number of symbols to be detected in one of the recurrent string patterns is sequentially incremented up to five; and a voice synthesis module for performing voice synthesis of the text characters of the series of characters, after deletion of the recurrent string pattern from the series of characters.

2. A voice synthesis apparatus according to claim 1, wherein the recurrent string pattern is comprised of one kind of symbol that is repeated a plurality of times and another kind of symbol.

3. A voice synthesis apparatus according to claim 2, wherein the paragraph section line includes the another kind of symbol added as a last character of the series of characters, at an end of the recurrent string pattern.

4. A voice synthesis apparatus according to claim 1, further comprising:

a second detection module that detects symmetrical patterns of symbol characters respectively at a beginning and an end of the series of character of one line, wherein said voice synthesis module performs voice synthesis of the text characters of the series of characters, after deletion of symbol character intervals from the series of characters, the symbol character intervals having been detected as symmetrical patterns by said second detection module.

5. A voice synthesis apparatus according to claim 4, wherein respective symbols of the symbol character intervals have symmetry with respect to shape.

6. A voice synthesis apparatus according to claim 5, further comprising a count module for counting up when a pair of symbols at symmetrical positions within the series of characters have the same shape, whereby the detection module deletes respective strings of symbol characters as the symbol character intervals when said count value is a predetermined value or more.

7. A voice synthesis apparatus for analyzing a series of characters from text including symbol characters and for outputting the characters by voice synthesis, comprising:

a detection module that detects a paragraph section line having a recurrent string pattern in the series of characters, and that deletes the paragraph section line from the series of characters so that all of the series of characters remain except for the paragraph section line, wherein the paragraph section line marks a boundary between paragraphs of the text, and the recurrent string pattern includes a plurality of strings each having a plurality of kinds or symbol characters; and a voice synthesis module that performs voice synthesis of all of the series of characters remaining after deletion of the paragraph section line by the detection module.

8. A voice synthesis apparatus of claim 7, wherein the recurrent string pattern includes one kind of symbol character that is repeated a plurality of times and another kind of symbol character.

* * * * *